US009770066B2

(12) United States Patent
Grelle et al.

(10) Patent No.: US 9,770,066 B2
(45) Date of Patent: Sep. 26, 2017

(54) NEUTRAL POSTURE ORIENTING FOOTBED SYSTEM FOR FOOTWEAR

(71) Applicant: BACKJOY ORTHOTICS, LLC, Boulder, CO (US)

(72) Inventors: James Keenan Grelle, Portland, OR (US); Willem J. L. Van Bakel, Veldhoven (NL)

(73) Assignee: Willem J. L. Van Bakel, Veldhoven (NL)

( * ) Notice: Subject to any disclaimer, the term of this patent is extended or adjusted under 35 U.S.C. 154(b) by 0 days.

(21) Appl. No.: 14/775,353

(22) PCT Filed: Mar. 13, 2014

(86) PCT No.: PCT/US2014/026788

§ 371 (c)(1),
(2) Date: Sep. 11, 2015

(87) PCT Pub. No.: WO2014/151995

PCT Pub. Date: Sep. 25, 2014

(65) Prior Publication Data

US 2016/0021972 A1 Jan. 28, 2016

Related U.S. Application Data

(60) Provisional application No. 61/800,719, filed on Mar. 15, 2013.

(51) Int. Cl.
*A43B 7/14* (2006.01)
*A43B 13/12* (2006.01)
(Continued)

(52) U.S. Cl.
CPC ..... *A43B 7/24* (2013.01); *A43B 7/14* (2013.01); *A43B 7/141* (2013.01); *A43B 7/142* (2013.01);
(Continued)

(58) Field of Classification Search
CPC ..... A43B 7/14; A43B 7/1405; A43B 7/1415; A43B 7/1425; A43B 7/1435; A43B 7/144; A43B 13/12; A43B 17/00
(Continued)

(56) References Cited

U.S. PATENT DOCUMENTS 2,423,622 A * 7/1947 Samblanet ..... A43B 7/14 36/176
2,502,774 A * 4/1950 Alianiello ..... A43B 7/1425 36/27
(Continued)

FOREIGN PATENT DOCUMENTS

WO WO-2013/028073 A1 2/2013

OTHER PUBLICATIONS

International Search Report and Written Opinion for PCT/US2014/026788, dated Jul. 29, 2014.
(Continued)

*Primary Examiner* — Marie Bays
(74) *Attorney, Agent, or Firm* — Brooks Acordia IP Law, P.C.; Michael Zarrabian

(57) ABSTRACT

A footbed system (10) for footwear comprises an insole mechanism (14), a midsole mechanism (11), wherein the insole mechanism is positioned on the midsole mechanism, and the outsole mechanism (15) is positioned under the midsole mechanism. The insole mechanism comprises a footbed insole (1), a heel pad (2) and a forefoot pad (3). The footbed insole comprises a pad anatomically shaped to correspond to the sole of a human foot, wherein the heel pad is positioned in the hindfoot portion of the footbed insole, and the forefoot pad is positioned in the forefoot portion of the footbed insole. The outsole mechanism comprises an opening (15A) for exposing a natural gait line groove of the midsole mechanism.

29 Claims, 15 Drawing Sheets

(51) Int. Cl.

| | |
|---|---|
| ***A43B 7/24*** | (2006.01) |
| ***A43B 7/22*** | (2006.01) |
| ***A43B 7/28*** | (2006.01) |
| ***A43B 13/38*** | (2006.01) |
| ***A43B 13/14*** | (2006.01) |
| ***A43B 17/02*** | (2006.01) |

(52) U.S. Cl.
CPC ..... *A43B 7/143* (2013.01); *A43B 7/144* (2013.01); *A43B 7/1405* (2013.01); *A43B 7/145* (2013.01); *A43B 7/148* (2013.01); *A43B 7/1415* (2013.01); *A43B 7/1425* (2013.01); *A43B 7/1435* (2013.01); *A43B 7/1445* (2013.01); *A43B 7/1465* (2013.01); *A43B 7/223* (2013.01); *A43B 7/28* (2013.01); *A43B 13/12* (2013.01); *A43B 13/127* (2013.01); *A43B 13/141* (2013.01); *A43B 13/386* (2013.01); *A43B 17/02* (2013.01)

(58) Field of Classification Search
USPC ..... 36/25 R, 43, 44, 30 R
See application file for complete search history.

(56) References Cited

U.S. PATENT DOCUMENTS 2,863,231 A * 12/1958 Jones ..... A43B 7/14 36/174
2,884,719 A * 5/1959 Compton ..... A43B 7/1425 36/145
4,364,188 A * 12/1982 Turner ..... A43B 5/06 36/129
4,506,460 A * 3/1985 Rudy ..... A43B 7/1495 36/28
4,667,423 A * 5/1987 Autry ..... A43B 13/12 36/102
4,759,136 A * 7/1988 Stewart ..... A43B 7/14 36/114
4,794,707 A * 1/1989 Franklin ..... A43B 7/14 36/107
4,813,159 A * 3/1989 Weiss ..... A43B 7/14 36/144
5,435,078 A * 7/1995 Pyle ..... A43B 13/12 36/28
5,572,805 A * 11/1996 Giese ..... A43B 13/12 36/103
5,704,137 A * 1/1998 Dean ..... A43B 17/03 36/28
6,038,790 A * 3/2000 Pyle ..... A43B 7/1425 36/28
6,065,230 A * 5/2000 James ..... A43B 3/0057 36/25 R
6,182,380 B1 * 2/2001 Liley ..... A43B 7/145 36/144
6,253,466 B1 7/2001 Harmon-Weiss et al.
6,453,578 B1 * 9/2002 Yung ..... A43B 7/142 36/166
D474,877 S * 5/2003 Belley ..... D2/953
6,938,363 B1 * 9/2005 Clough ..... A43B 7/145 36/117.5
7,484,319 B2 * 2/2009 Cheskin ..... A43B 7/141 36/144
7,634,861 B2 * 12/2009 Kilgore ..... A43B 3/26 36/102
7,849,610 B2 * 12/2010 Clough ..... A61F 5/14 36/140
7,941,941 B2 * 5/2011 Hazenberg ..... A43B 1/0009 36/25 R
7,946,058 B2 * 5/2011 Johnson ..... A43B 3/0057 36/102
8,127,468 B2 * 3/2012 Morgan ..... A43B 13/12 12/142 T
8,250,784 B2 * 8/2012 Cheskin ..... A43B 7/141 36/144
8,661,709 B2 * 3/2014 Campbell ..... A43B 7/1425 36/28
8,726,542 B2 * 5/2014 Kim ..... A43B 13/127 36/103
8,752,307 B2 * 6/2014 Cooper ..... A43B 1/0072 36/102
2003/0150131 A1 8/2003 McManus et al.
2004/0181970 A1 * 9/2004 Covatch ..... A43B 7/1425 36/30 R
2005/0262739 A1 * 12/2005 McDonald ..... A43B 3/0057 36/102
2006/0059726 A1 * 3/2006 Song ..... A43B 7/142 36/142
2007/0033834 A1 * 2/2007 Cheskin ..... A43B 7/141 36/44
2007/0193071 A1 8/2007 Gilmore
2009/0013559 A1 1/2009 Chan et al.
2011/0131835 A1 6/2011 Cheskin et al.
2014/0041261 A1 * 2/2014 Walker ..... A43B 3/0057 36/25 R
2014/0047740 A1 * 2/2014 Tucker ..... A43B 7/14 36/103
2016/0021972 A1 * 1/2016 Grelle ..... A43B 3/0057 36/140

OTHER PUBLICATIONS

Third Party Observation and comments for PCT/US2014/026788, submitted Mar. 20, 2015.
Search Report and Written Opinion for EP Application No. 14768692.7 dated Dec. 8, 2016.

* cited by examiner

NEUTRAL POSTURE ORIENTING FOOTBED SYSTEM FOR FOOTWEAR

CROSS-REFERENCE TO RELATED APPLICATION

This application claims the priority benefit of U.S. Provisional Patent Application Ser. No. 61/800,719, filed Mar. 15, 2013, incorporated herein by reference in its entirety.

FIELD OF THE INVENTION

The present invention relates generally to footwear, and in particular to footbed systems for footwear.

BACKGROUND

Humans who are standing or walking have often problems in achieving an active, neutral and stable body position, resulting in biomechanical issues. Conventional footwear are ineffective in providing natural and neutral posture correction for a human being wearing the footwear.

BRIEF SUMMARY

In one embodiment, a footbed system for footwear comprises an insole mechanism, a midsole mechanism, wherein the insole mechanism is positioned on the midsole mechanism, and the outsole mechanism is positioned under the midsole mechanism. The insole mechanism comprises a footbed insole, a heel pad and a forefoot pad. The footbed insole comprises a pad anatomically shaped to correspond to sole of a human foot, wherein the heel pad is positioned in the hindfoot portion of the footbed insole, and the forefoot pad is positioned in the forefoot portion of the footbed insole. The outsole mechanism comprises an opening for exposing a natural gait line groove of the midsole mechanism.

These and other features, aspects and advantages of the present invention will become understood with reference to the following description, appended claims and accompanying figures.

BRIEF DESCRIPTION OF DRAWINGS

FIG. 3D-3 shows relationships between a footbed insole, a forefoot pad and a heel pad 2 of the footbed system, in relation to FIGS. 3D-1 and 3D-2, according to an embodiment.

DETAILED DESCRIPTION OF THE INVENTION

The following description is made for the purpose of illustrating the general principles of the disclosed embodiments of a system, and is not meant to limit the disclosed concepts herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

Embodiments of a footbed system for footwear providing neutral posture orienting, are disclosed herein. The footbed system enables achieving neutral posture for a wearer while he is standing or walking.

In one embodiment, the footbed system comprises an active insole mechanism and a natural gait line mechanism. The footbed system functions utilizing a dynamic combination of said insole mechanism and said natural gait line mechanism to position the foot into a neutral posture correct position.

Gait is the pattern in which a person walks or runs (i.e., personal step by step "cycle"). In one embodiment, Gait Analysis is employed as a process for examining such "cycles", and detecting variations and possible abnormalities. The cycles are captured, documented and observed during Computerized Gait Analysis Sessions. The analysis is used in developing a gait line (preferably most ideal gait line) for standing and to start walking.

Embodiments of the footbed system improve (and preferably optimize) the gait in such a way that the human weight distribution in the foot and path of motion is aligned with strong skeleton structures and connective tissue, resulting in well balanced muscular interaction.

In one embodiment, the footbed system further comprises a midsole mechanism and an outsole mechanism, wherein the midsole mechanism may be integrated with the outsole mechanism, and the insole mechanism may be removable. The midsole mechanism and the outsole mechanism include features for implementing the natural gait line mechanism.

Figure 1A:
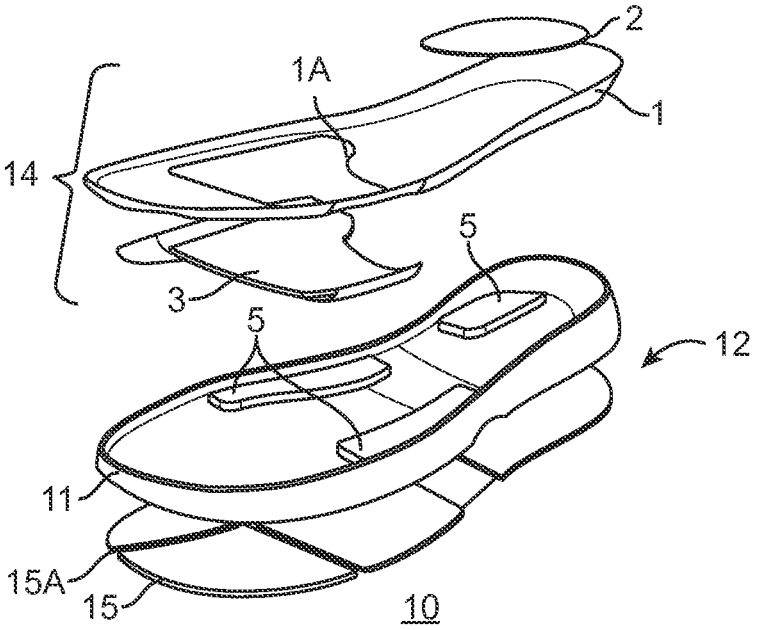
FIG. 1A shows an exploded view of an embodiment of a footbed system disclosed herein.
Figure 1B:
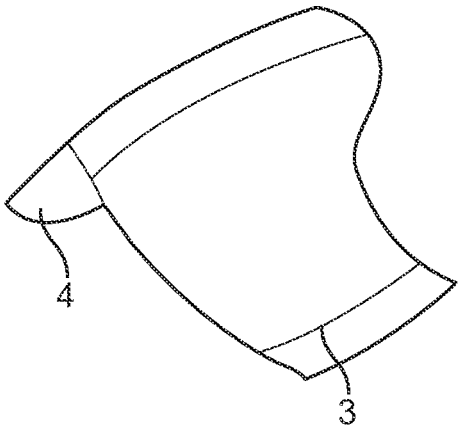
FIG. 1B illustrates the forefoot pad of the footbed system of FIG. 1A, including a first metatarsal lift support, according to an embodiment.
Figure 1C:
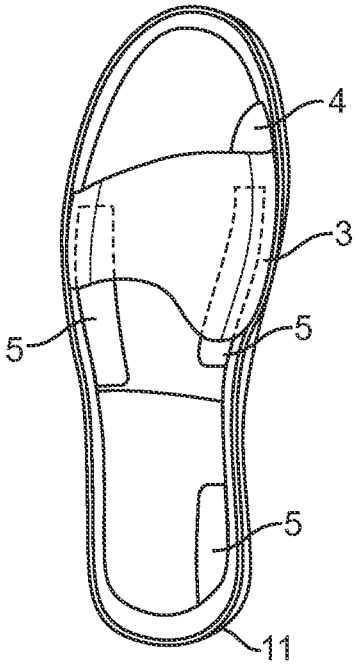
FIG. 1C shows a top view of a midsole of the footbed system of FIG. 1A with the gait line supports positioned thereon, according to an embodiment.

FIGS. 1A-1C show a footbed system in one embodiment. FIG. 1A shows an exploded view of an embodiment of a footbed system 10 comprising at least a portion of footwear (e.g., shoe). In one embodiment, the footbed system 10 comprises an essentially layered design including a midsole mechanism 11, an active insole (footbed) mechanism 14, and an outsole mechanism 15. The active core insole mechanism 14 positions the foot into a neutral posture correct position.

The footbed system 10 functions utilizing a dynamic combination of the insole mechanism 14 and a natural gait line mechanism 12 implemented by cooperation of the midsole mechanism 11 (FIG. 1C) and the outsole mechanism 15.

Figure 4:
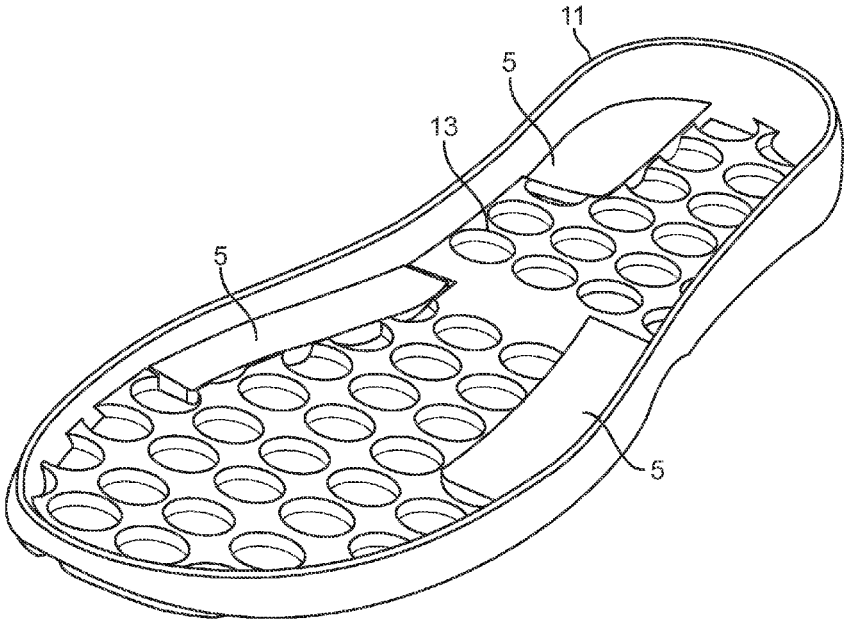
FIG. 4 shows placement of gait line supports in the footpad system, according to an embodiment.
Figure 10:
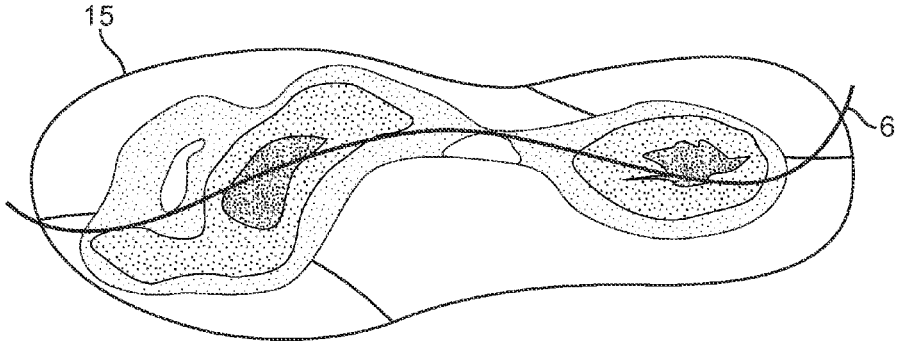
FIG. 10 shows a natural gait line groove of the footbed system superimposed on the sole of a human foot, according to one embodiment.

In one embodiment, the natural gait line mechanism 12 comprises a natural gait line groove 6 (FIG. 7A) in the midsole 11 that is exposed by the outsole 15. FIG. 10 shows a representation of the natural gait line 6 in relation to the outsole 15 foot, with a pressure map illustrated by shaded areas (darker shading indicated more pressure). In another embodiment, natural gait line mechanism 12 further includes active gait line supports 5 selectively placed on the midsole 11, as shown in FIG. 4. In one embodiment, gait line supports 5 can be integrated into the outsole 15, as shown in a top view of an embodiment of the outsole 15 in FIG. 2D.

The footbed system 10 provides active core stability, relieves trigger points under feet, and supports for first metatarsal (first beam) support for stability while standing or walking. An embodiment of the footbed system 10 comprises a molded material for improving comfort, stability, anti-slip or ESD (Electro Static Discharge) material. An example of the molded material is Ethylene-Vinyl Acetate (EVA), but several other materials (e.g., Polyurethane, Expanded Polymer Foam) can be used in the footbed system 10.

The insole mechanism 14 comprises a footbed insole 1, an active core heel pad 2 and an active core forefoot pad 3 including a first metatarsal lift support 4. FIG. 1B illustrates the forefoot pad 3 including a first metatarsal lift support 4. FIG. 1C shows a top view of the midsole 11 with the gait line supports 5 positioned thereon, and the forefoot pad 3 including the first metatarsal lift support 4 placed on the midsole 11.

Figure 2A:
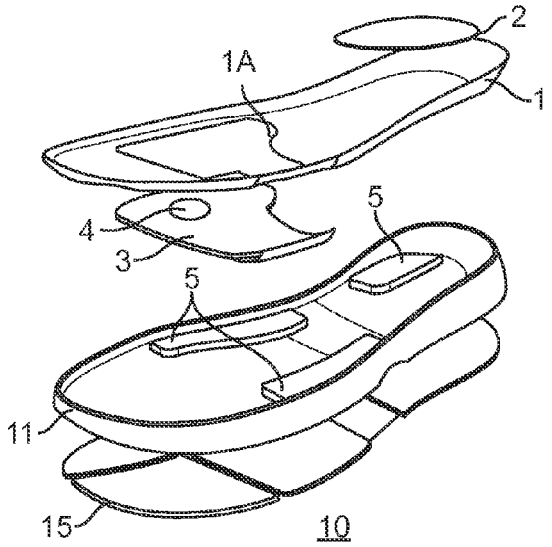
FIG. 2A shows an exploded view of another embodiment of a footbed system disclosed herein.
Figure 2B:
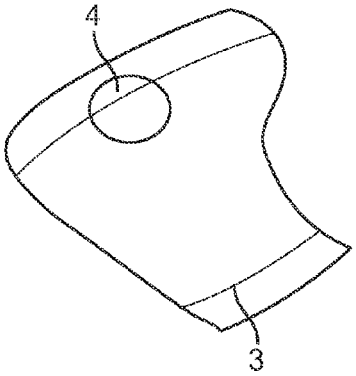
FIG. 2B illustrates the forefoot pad of the footbed system of FIG. 2A, including a first metatarsal lift support, according to an embodiment.
Figure 2C:
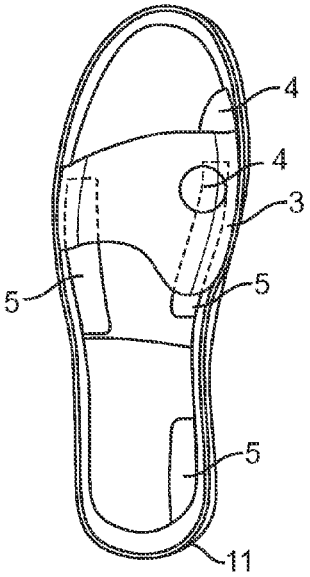
FIG. 2C shows a top view of a midsole of the footbed system of FIG. 2A with the gait line supports positioned thereon, according to an embodiment.
Figure 2D:
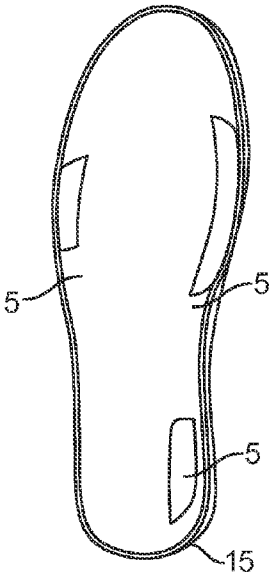
FIG. 2D shows a top view of gait line supports integrated into an outsole of the footbed system of FIG. 1A and FIG. 2B, according to an embodiment.

FIGS. 2A-2C show another embodiment of the forefoot pad 3 in the footbed system 10, wherein the first metatarsal lift support 4 comprises an essentially arcuate (curved) extension of the forefoot pad 3 in the frontal forefoot area of the footbed system. Specifically, FIG. 2A shows an exploded view of the footbed system, FIG. 2B illustrates the forefoot pad 3 of the footbed system of FIG. 2A, and FIG. 2C shows a top view of the midsole 11 of the footbed system of FIG. 2A with the gait line supports 5 positioned thereon, and the forefoot pad 3 including the first metatarsal lift support 4 placed on the midsole 11.

Figure 3A:
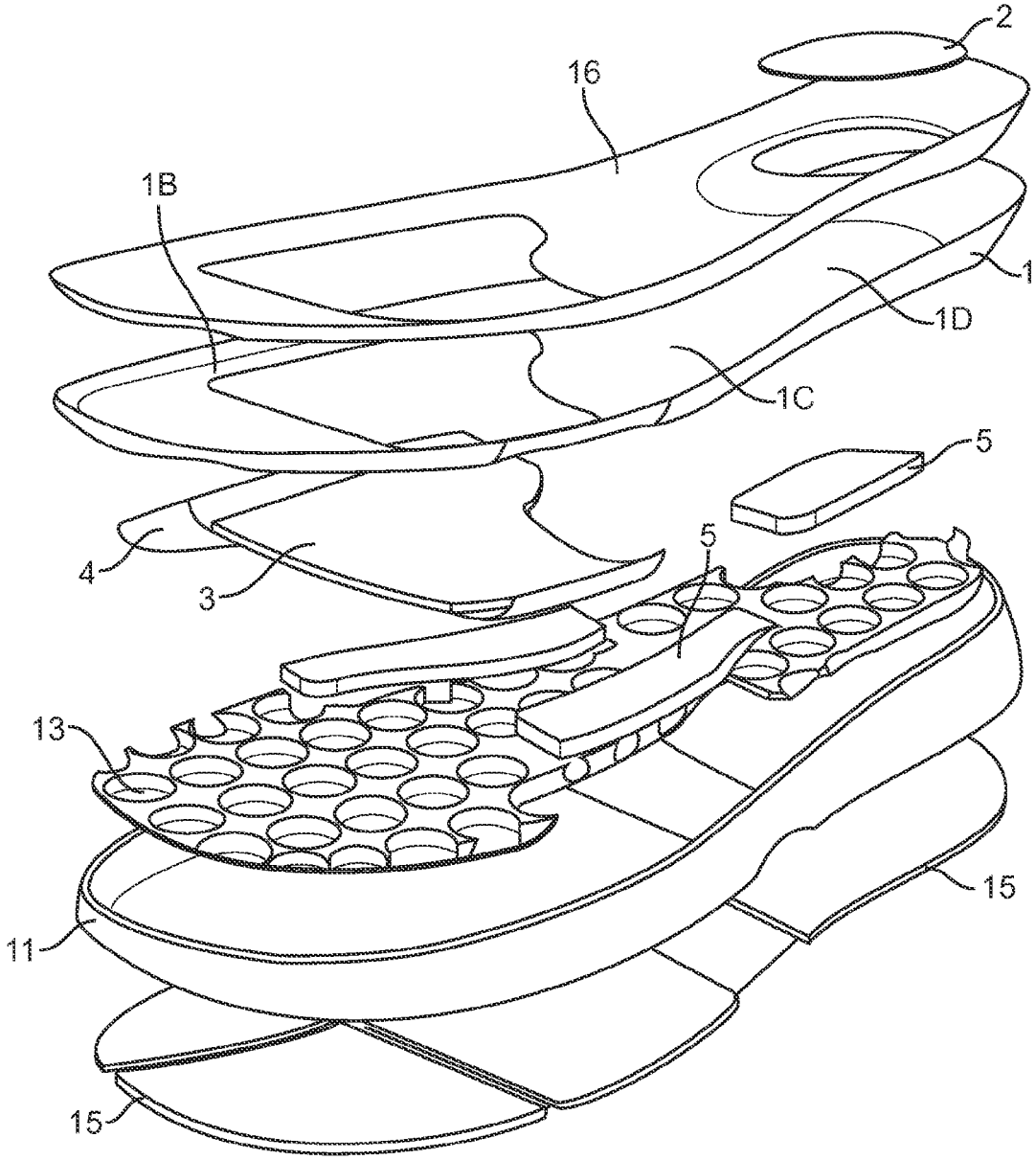
FIG. 3A shows another example of the footbed system of FIG. 1A further including an optional cover and optional padding layer, according to an embodiment.
Figure 3B:
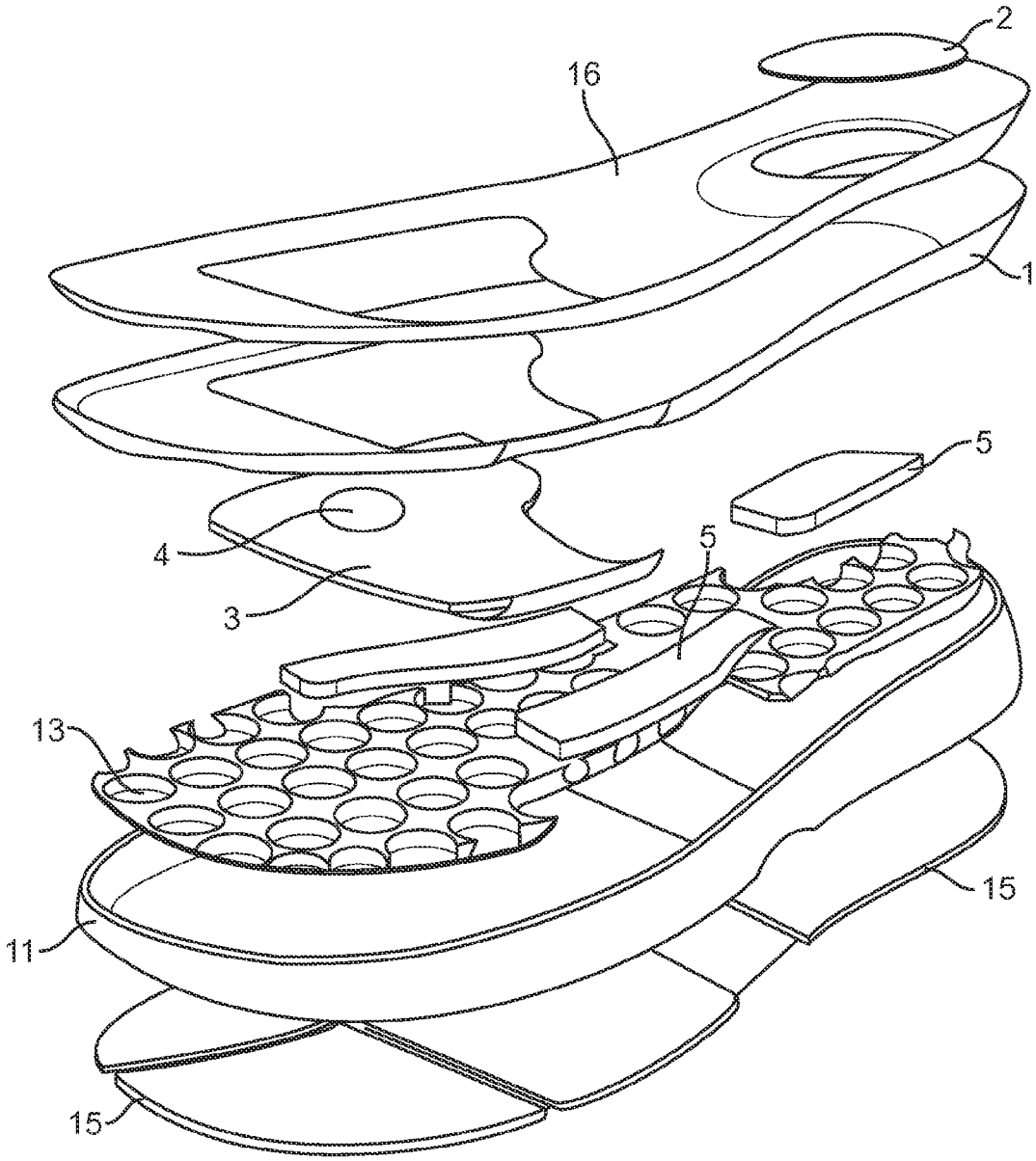
FIG. 3B shows another example of the footbed system of FIG. 2A further including an optional cover and optional padding layer, according to an embodiment.

FIG. 3A shows another example of the footbed system of FIG. 1A further including optional cover 16 and optional padding layer 13. FIG. 3B shows another example of the footbed system of FIG. 2A further including optional cover pad 16 and optional padding layer 13.

Figure 3C:
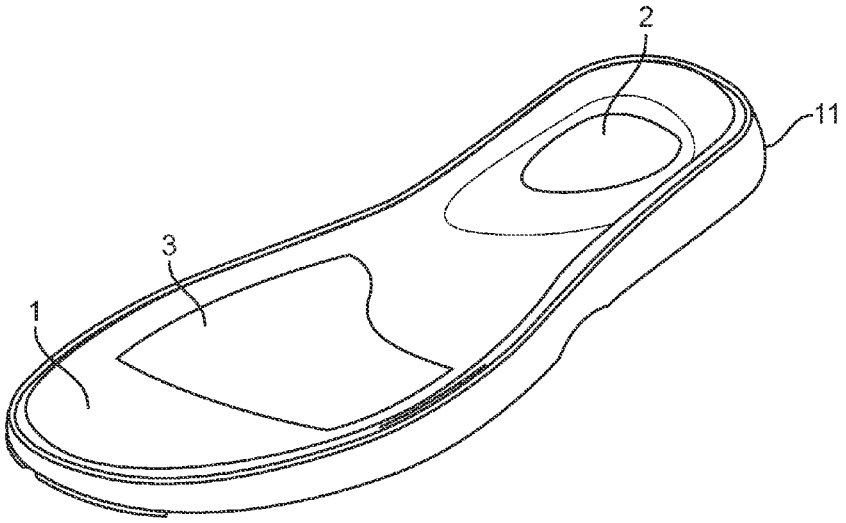
FIG. 3C shows a footbed insole placed on the forefoot pad including the first metatarsal lift support, according to an embodiment.

FIG. 3C shows the footbed insole 1 placed on the forefoot pad 3 including the first metatarsal lift support 4, wherein the forefoot pad 3 is at least partially exposed by a opening 1A of the footbed insole 1. Further, the heel pad 2 is placed on the footbed insole 1.

In one embodiment, energy damping foam (EDF) material is utilized, wherein EDF material absorbs more of the impact shock energy, primarily through a difference in material hardness and density. The energy dampening foam material can be made from different chemical Polymers such a foamed Polymers including foamed PU (Polyurethane), foamed EVA, PE (Polyethylene foam), etc. In one implementation, forefoot pad 3 and heel pad 2 are made from EDF material. In one embodiment, the footbed insole 1 comprises EVA material or PU (Polyurethane).

An embodiment of the footbed system comprises footwear such as a shoe including said insole mechanism 14 including the first metatarsal (first beam) support 4. The first metatarsal support 4 in the forefoot zone, provides foot stability while standing and walking. The first metatarsal support 4 also provides active core stability in static and dynamic phase.

In one implementation, the neutral footbed insole 1 comprises a molded footbed member anatomically and biomechanically engineered generally in the shape of the sole of a human foot, to provide structural support to the foot for a natural and neutral position aiding in better posture and comfort. The footbed insole 1 is flexible and comprises a forefoot portion 1B (FIG. 3C), a midfoot portion 1C (FIG. 3C) and a hindfoot portion 1D (FIG. 3C). The hindfoot portion is shaped to support the Calcaneus (or heel bone). The midfoot is shaped to support the arch of the foot. The forefoot portion is shaped to support the toes and the corresponding five proximal long bones.

The midsole mechanism 11 comprises a flexible elongated bed (pad) anatomically shaped to correspond to the sole of a human foot, generally similar in shape to the footbed insole 1, and has hindfoot, midfoot and forefoot portions. The outsole mechanism 15 comprises a flexible elongated bed anatomically shaped to correspond to the sole of a human foot, generally similar in shape to the midsole mechanism 11, and has hindfoot, midfoot and forefoot portions.

The active core insole mechanism 14 further comprises said active core heel pad 2, wherein when the wearer's weight is load borne through the foot, the pressure on the Calcaneus is absorbed in the active core heel pad 2. In one implementation, the active core heel pad 2 comprises a molded energy damping foam engineered in the natural shape of the Calcaneus.

In one embodiment, the footbed system 10 utilizes active core stability material for the insole mechanism 14 such as the heel pad 2, wherein the central hardness of said material is softer than typical material (EVA/Foam). The heel of the wearer depresses the softer material of the heel pad 2 which provides lateral and medial pressure (indicated by arrows), and stability as shown in FIG. 11E. This provides active core stability and active pronation/supination control, tested with pressure sensors.

The shape and angle of the active core heel pad 2 relieves pressure and adds comfort to the Plantar Fascia. Additionally, the active core heel pad 2 places the foot in a neutral position and aids in controlling over-pronation and supination. This is achieved because the active core heel pad 2 allows the Cancaneus to press downwards in the softer over a natural gait line groove 6 in the outsole 15, wherein harder foam of the footbed insole 1 is positioned around the heel pad 2.

As such, soft tissues of the foot follow the path of least resistance and move down into the softer foam of the heel pad 2 over the natural gait line groove 6, bringing the bone structure inside the foot soft tissues toward the preferred gait line 6. This results in automatic pressure at the lateral and medial sides of the heel and creates stability and a neutral position.

The active core insole mechanism 14 further comprises said active core forefoot pad 3 which cushions and supports the forefoot (metatarsals and metatarsal heads). In one implementation, the active core forefoot pad 3 comprises a molded energy damping foam engineered in the natural shape of the Metatarsals, and distributes the force/pressure under the forefoot sidewardly, in an essentially horizontal surface, and provides improved pressure distribution. The shape of the active core forefoot pad 3 allows pressure relief and adds comfort to the Plantar Fascia. The forefoot pad 3 can be of similar material as the heel pad 2.

The active core insole mechanism 14 further comprises said first metatarsal lift support 4 extending from the forefoot pad 3, comprising a molded energy damping foam engineered in the natural shape of the first metatarsal head bone of the human foot (i.e., first beam, big toe). The shape of the first metatarsal lift support 4 creates additional support and assists in stabilizing the foot position. The first metatarsal lift support 4 can be of similar material as the forefoot pad 3.

The active core insole mechanism 14 functions in conjunction with said natural gait line mechanism 12 to position the foot in an anatomically neutral position while the wearer is standing on the footbed system 10, which is beneficial for good posture. As shown in FIG. 8B, the natural gait line mechanism 12 comprises a natural gait line groove 6 in the midsole 11 and active gait line supports 5. In one embodiment, the groove 6 is arcuate in shape (e.g., generally elongated S-shaped) and is positioned in the underside of the midsole mechanism 11 shown in FIGS. 2A, 3A, and extends between the forefoot and hindfoot, essentially aligned with a midline of the midsole mechanism 11.

FIGS. 5A-5E illustrate positioning of the forefoot pad 3 and heel pad 2 (shape and geometry) of the footbed system of FIG. 1A, and relationship to a human foot.

Figures 2, 5B:
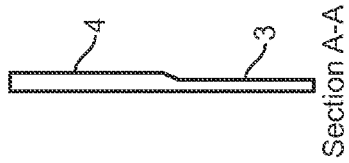
FIGS. 5A-5E illustrate placement of the forefoot pad and heel pad in the footbed system of FIG. 1A in relation to a foot, according to an embodiment.
Figures 1, 5B:
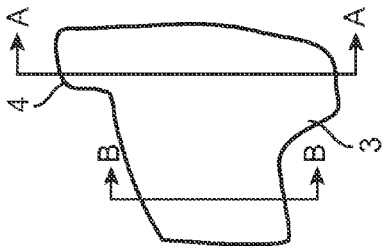
Figures 3, 5B:
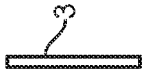
Figure 5A:
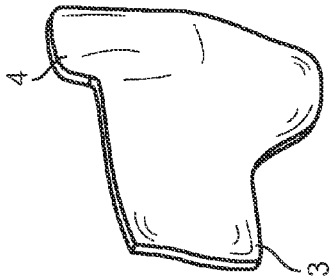
Figures 2, 5D:
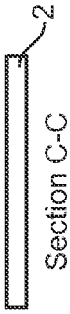
Figures 1, 5D:
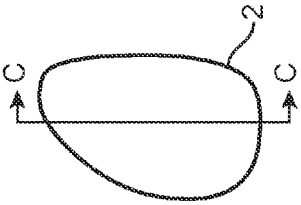
Figure 5E:
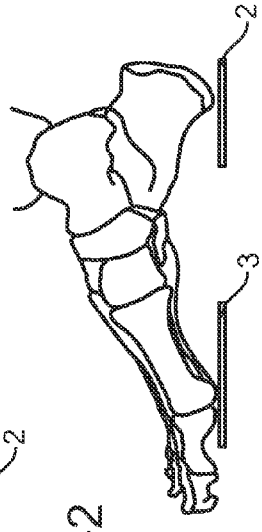
Figure 5C:
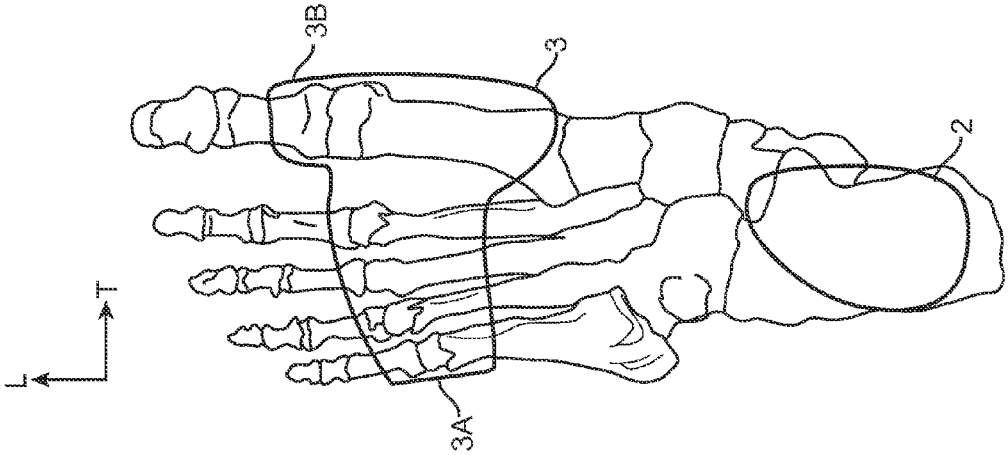

FIG. 5C illustrates positioning of the forefoot pad 3 and heel pad 2 (shape and geometry) of the footbed system 10 and relationship to a human foot. FIG. 5A shows a perspective view of the forefoot pad 3 with an integrated first metatarsal support 4. A longitudinal axis L and a transverse axis T are also shown in FIG. 5A. In one example, the forefoot pad 3 comprises an elongated bed in the transverse direction, having an inner edge 3A extending along a contour of the medial side of the forefoot, and an outer edge 3B extending longitudinally in a zone substantially between the lateral margin of the first toe and first metatarsal and medial margin of the second toe and second metatarsal. The outer edge 3B is longitudinally longer than the inner edge 3A.

Figures 1, 3D:
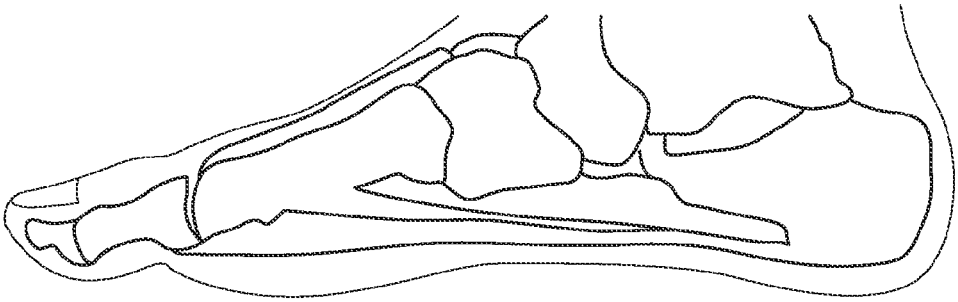
FIGS. 3D-1 and 3D-2 illustrate human foot ligaments and tendons.
Figures 2, 3D:
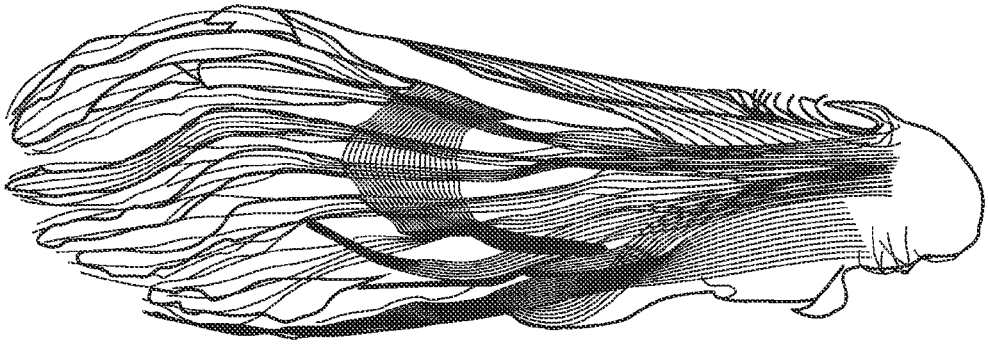
Figures 3, 3D:
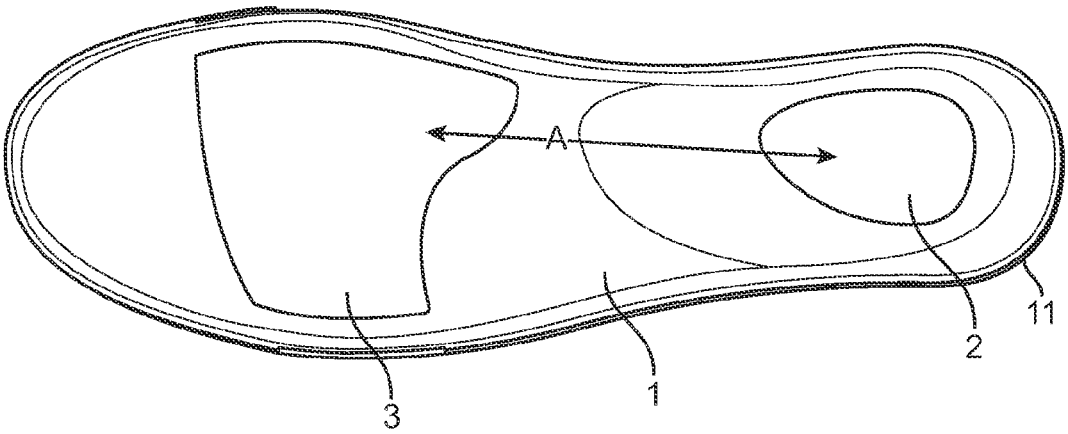

FIG. 5B-1 shows a plan view of the forefoot pad 3 of FIG. 5A. FIG. 5B-3 shows a cross-section of the forefoot pad 3 proximate the edge 3A thereof (along lines B-B), having an essentially rectangular shape. FIG. 5B-2 shows a cross-section of the forefoot pad 3 proximate the edge 3B thereof (along lines A-A), having an essentially rectangular shape, wherein the region for first metatarsal support 4 is thicker than other regions of the forefoot pad 3.

FIG. 5D-1 shows a plan view of the heel pad 2, and FIG. 5D-2 shows a cross-section view of the heel pad 2 (along lines C-C) having an essentially rectangular in shape. FIG. 5E shows a side view of position of foot bones relative to the forefoot pad 3 and heel pad 2 in the footbed system 10.

In one embodiment, the footbed insole 1 comprises an elongated bed (pad) in the longitudinal direction, having said opening 1A for exposing the forefoot pad 3 therethrough. The opening 1A is generally in the shape of the forefoot pad 3.

FIGS. 6A-6E illustrate positioning of the forefoot pad 3 and heel pad 2 (shape and geometry) of the footbed system of FIG. 2A, and relationship to a human foot.

Figures 2, 6B:
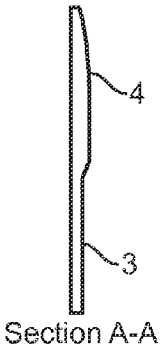
FIGS. 6A-6E illustrate placement of the forefoot pad and heel pad in the footbed system of FIG. 2A in relation to a foot, according to an embodiment.
Figures 1, 6B:
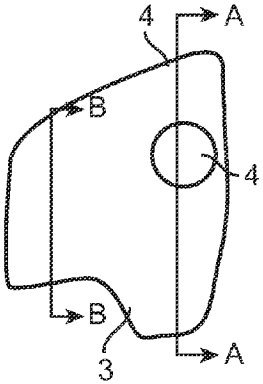
Figures 3, 6B:
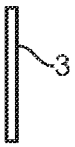
Figure 6A:
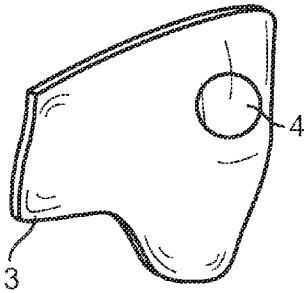
Figures 2, 6D:
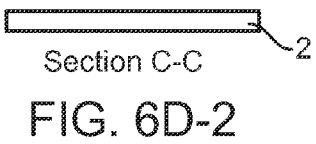
Figures 1, 6D:
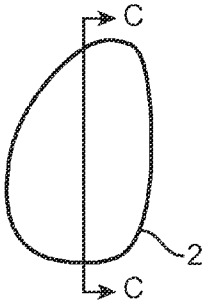
Figure 6E:
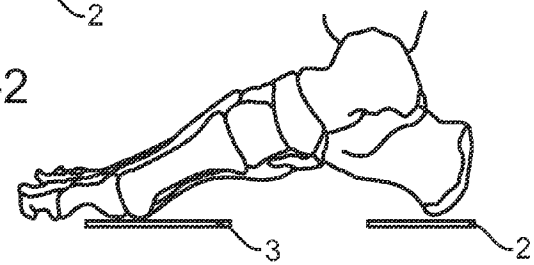
Figure 6C:
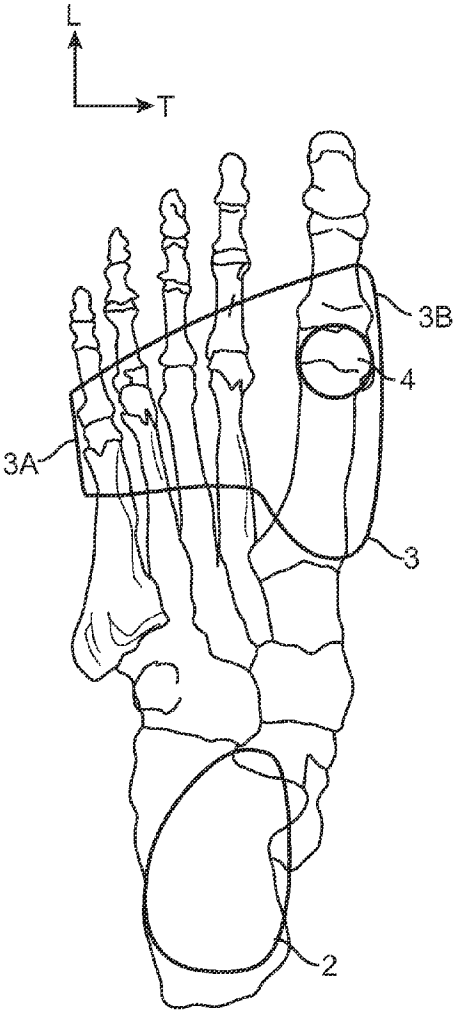

FIG. 6C illustrates positioning of the forefoot pad 3 and heel pad 2 (shape and geometry) of the footbed system 10 and relationship to a human foot. FIG. 6A shows a perspective view of the forefoot pad 3 with an integrated first metatarsal support 4, wherein the first metatarsal lift support 4 comprises an essentially arcuate (curved) extension of the forefoot pad 3 in the frontal forefoot area of the footbed system. A longitudinal axis L and a transverse axis T are also shown in FIG. 6A. In one example, the forefoot pad 3 comprises an elongated bed in the transverse direction, having an inner edge 3A extending along a contour of the medial side of the forefoot, and an outer edge 3B extending longitudinally in a zone substantially between the lateral margin of the first toe and first metatarsal and medial margin of the second toe and second metatarsal. The outer edge 3B is longitudinally longer than the inner edge 3A.

FIG. 6B-1 shows a plan view of the forefoot pad 3 of FIG. 6A. FIG. 6B-3 shows a cross-section of the forefoot pad 3 proximate the edge 3A thereof (along lines B-B), having an essentially rectangular shape. FIG. 6B-2 shows a cross-section of the forefoot pad 3 proximate the edge 3B thereof (along lines A-A), having an essentially rectangular shape, wherein the region for first metatarsal support 4 is thicker than other regions of the forefoot pad 3.

FIG. 6D-1 shows a plan view of the heel pad 2, and FIG. 6D-2 shows a cross-section view of the heel pad 2 (along lines C-C) having an essentially rectangular in shape. FIG. 6E shows a side view of position of foot bones relative to the forefoot pad 3 and heel pad 2 in the footbed system 10.

In one embodiment, the forefoot pad 3 and heel pad 2 are integrated into the footbed insole 1, rather than separate elements, and the forefoot pad 3 does not have an opening 1A. FIG. 3D-3 shows relationships between footbed insole 1, forefoot pad 3 and heel pad 2, and illustrates how foot ligaments and tendons (FIGS. 3D-1 and 3D-2) are affected by these relationships. The forefoot pad 3 and heel pad 2 are softer material than the midsole 11 under the footbed insole 1.

FIG. 3D-3 shows an arrow A between heel pad 2 and forefoot pad 3, in the midfoot area, to illustrate a bridging effect between heel pad 2 and forefoot pad 3. The softer heel pad 2 and forefoot pad 3 (relative to the underlying midsole 11) allow the heel and forefoot of the wearer to sink down into the heel pad 2 and forefoot pad 3, respectively, whereas the midsole 11 holds up the foot area between the heel pad 2 and forefoot pad 3. This is part of the path of least resistance in moving the bones into the natural gait line.

In one embodiment, footbed insole 1 ranges in hardness from about 40±3 Asker C hardness, the active core pads (i.e., heel pad 2 and forefoot pad 3) are about 25 to 30 Asker C hardness. In one embodiment, the midsole mechanism 11 comprises EVA material with a hardness range from about 40 to 55 Asker C hardness.

In one example, the midsole 11 comprises EVA material with a hardness ranging from about 40 to 55 Asker C hardness, and the natural gait line groove 6 is a groove in the midsole EVA exposed by similarly shaped opening 15A (FIG. 1A) in the outsole 15.

In one embodiment, the outsole 15 comprises a rubber or rubber-like polymer with a hardness ranging from about 65 to 70 Shore A hardness. In one embodiment, the active core stabilizers 5 may be integrated into the outsole mechanism 15 (FIG. 7C).

In one embodiment, the active gait line supports 5 comprise generally planar and rectangular structures molded from polymers. The active gait line supports 5 are selectively positioned between the midsole 11 and the footbed insole 1, and provide a change in density under the foam used for the midsole 11. The gait line supports 5 can also be placed between the midsole 11 and the outsole 15. The support pads 5 (e.g., support pads S1, S2, S3) on the midsole 11 function as gait line supports that comprise raised rubber outsole rails/guides that align the foot inward toward a natural gait line 6.

Figure 7A:
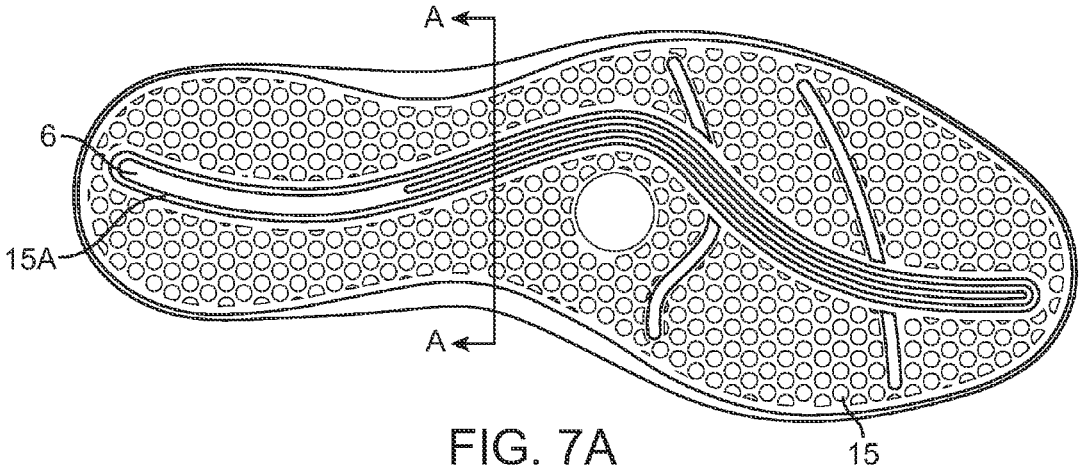
FIG. 7A shows a bottom view of the outsole of the footbed system, according to an embodiment.
Figure 7B:
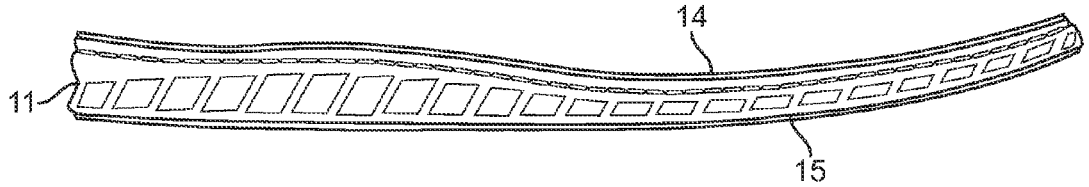
FIG. 7B a side view of the assembled footbed system, according to an embodiment.
Figure 7C:
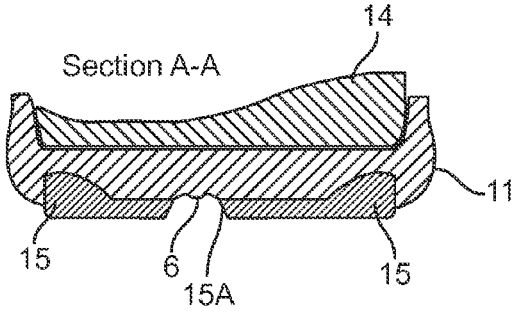
FIG. 7C shows a section view of the footbed system of FIG. 7A, according to an embodiment.

FIG. 7A shows bottom view of the outsole 15 which exposes groove 6 in the midsole 11 (e.g., 1 mm-10 mm in depth). FIG. 7B shows a profile of the footbed system 10, and FIG. 7C shows a cross section of the footbed system 10 along A-A. Gait line groove 6 provides a natural gait line, wherein gait line supports 5 are built into the midsole 11 in this embodiment.

The active gait line supports 5 guide the foot back to the natural gait line groove 6. The natural gait line groove 6 comprises a channel that provides a change in density of the midsole 11 which guides the foot back to the natural gait line 6.

Using harder material for the outsole 15 than the material of the midsole 11, in the area of the natural gait line groove 6 where there is no outsole material and the midsole 11 is exposed, the density of the midsole 11 is less where the outsole 15 is not layered to the midsole 11.

The gait line groove 6 is an example of selective layering of outsole 15 on the midsole 11, according to embodiments of the footbed system 10. Such material and geometry of the midsole mechanism 11 and outsole mechanism 15 are selected to have varying density of foam when weight bearing.

Figure 8A:
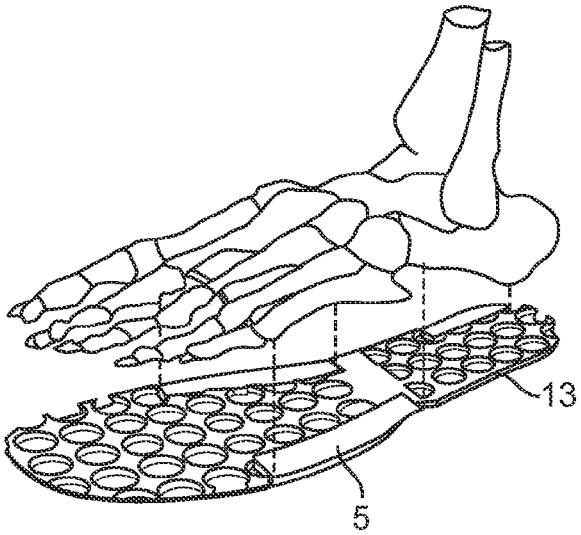
FIGS. 8A-8D shows placement of gait line support pads in the footbed system in relation to a human foot, according to an embodiment.
Figure 8B:
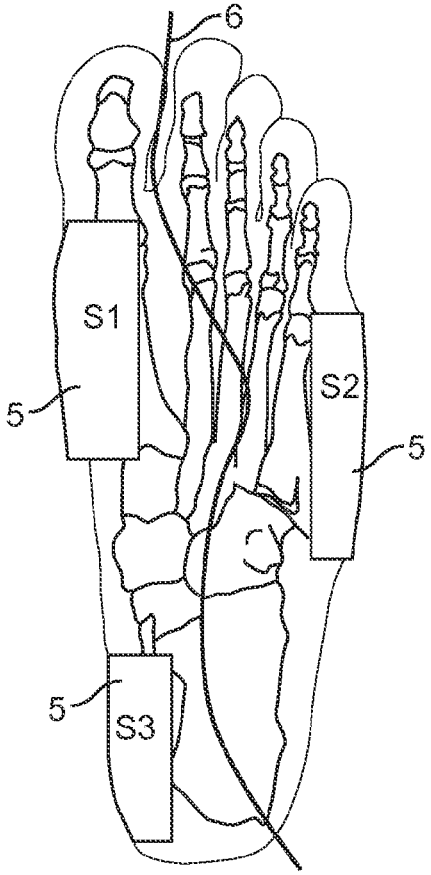
Figure 8C:
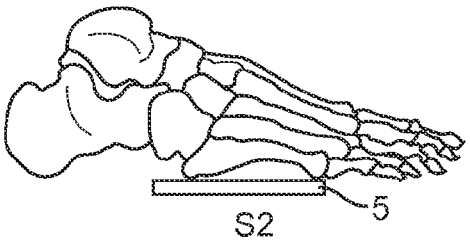
Figure 8D:
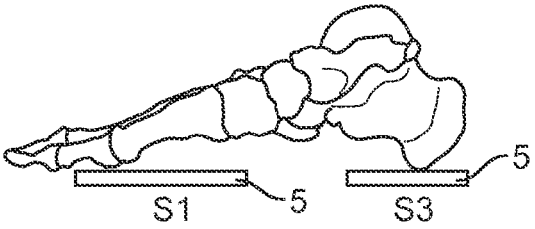

FIG. 8A shows a perspective view of position of support pads 5 relative to the foot bones. FIG. 8B shows a bottom view of the foot and action of support pads 5 (S1, S2, S3) of the footbed system 10 on the foot, along with natural gait line 6. Two of the support pads 5 (i.e., S1 and S2) are positioned essentially on either side of the forefoot, and one of the support pads (i.e., S3) is placed essentially on an inner side of the heel. In the example shown in FIG. 8B, support pads S1 and S3 are on the inner side of the footbed, while the support pad S2 is on the outer side of the footbed, positioned on the peripheries of the footbed to follow the natural gait line 6. FIG. 8D shows a side view of the foot and relative position of two support pads 5 (i.e., support pads S1, S3) relative to the foot bones. FIG. 8C shows an opposing side view of the foot and relative position of a third support pads 5 (i.e., support pad S2) relative to the foot bones.

In assembly, the support pads 5 are placed on top of the midsole 11, and the forefoot pad 3 and first metatarsal support 4 are also placed on the midsole 11, wherein the forefoot pad 3 covers at least a portion of two of the supports pads 5 (e.g., support pads S1 and S2) that are positioned along the edges 3A and 3B of the forefoot pad 3. The third support pad 5 (e.g., support pad S3) is placed proximate a side of the heel pad 2. The support pads 5 can also be placed on the outsole 15.

The footbed insole 1 is then placed on the forefoot pad 3, the first metatarsal support 4, and the supports pads 5, wherein the forefoot pad 3 is exposed through the opening 1A of the footbed insole 1. The first metatarsal support 4 and the support pads 5 are covered by the footbed insole 1. The heel pad 2 is then placed on the heel area of the footbed insole 1.

The footbed insole 1, along with forefoot pad 3 and heel pad 2, and supports 5, implemented in footwear improve human biomechanics and reduce the discomfort in standing and moving. The relationship of heel pad 2 with the midsole 11, and relationship of heel pad 2 to the forefront pad 3, provides a "bridge" for the foot over the midsole 11. The outsole 15 has selective lamination to the midsole 11 (due to the groove 6), and in one example the supports 5 are built into the outsole 15 instead of the midsole 11.

Foams about Shore A hardness 30 in density deform under a humans weight. The footbed system comprises different density foams not only to provide pressure deflection and absorption but by using different densities in particular relationship to one another to make the foot move to a desired position by means of least resistance, rather than by standard forces to conform into the shape of the shoe.

Figure 11A:
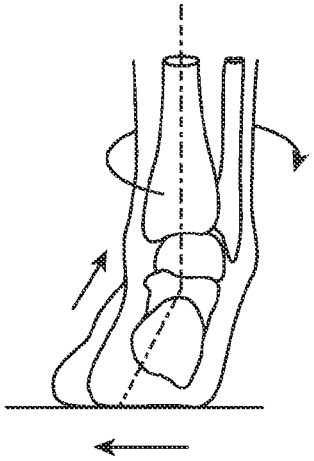
FIGS. 11A-11C show different foot positions of a standing human being.
Figure 11B:
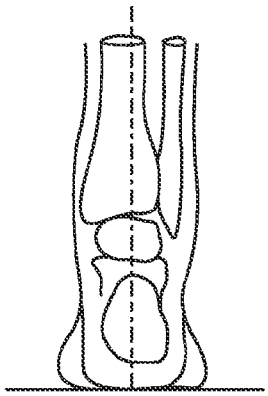
Figure 11C:
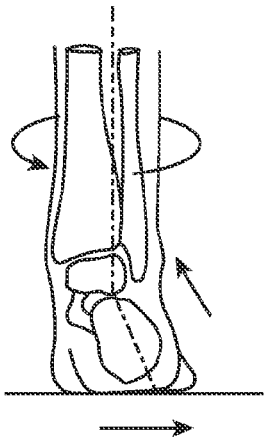

FIGS. 11A-11C show different foot positions, wherein FIG. 11A illustrates an over-supinated foot position, FIG. 11B illustrates a neutral foot position and FIG. 11C illustrates a over-pronated foot position. If the feet are excessively pronated, as is often the case with majority of the population, the excessively pronated side can facilitate internal rotation of the femur and lower leg and lower that side of the pelvis while walking and standing.

Figure 11D:
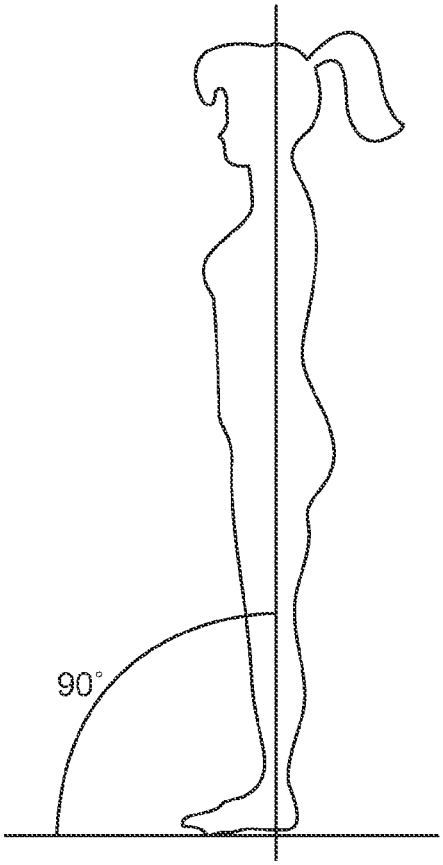
FIG. 11D shows correct posture of a standing human being.
Figure 11E:
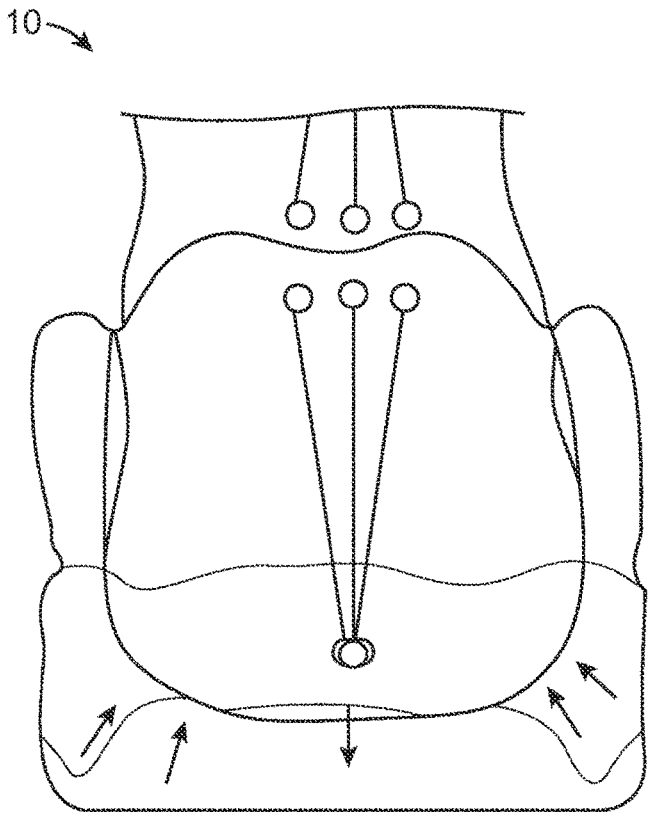
FIG. 11E shows lateral and medial pressure provided by the footbed system on a human foot for providing correct posture, according to one embodiment.

The subtalar joint neutral position (when the foot is not pronated nor supinated, and the middle diagram above) is recognized by foot professionals as the neutral position of most stability. As mentioned, if the foot operates outside of this neutral position, dysfunction in the foot, leg, pelvis and back may occur and create a negative position. The footbed system 10 promotes a neutral foot position as in FIG. 11B, resulting in proper posture as illustrated in FIG. 11D.

In an over-pronation foot position, there is too much pronation wherein the foot rolls inward excessively. There is an angle between the heel bone and the Achilles tendon and much pressure on the ball of the foot. Low arches are at increased risk of over-pronation. Individuals with over-pronation have increased risk of walking discomforts such as knee, Achilles or shin, leg, pelvis, back complaints.

Pronation of the foot is a normal process that occurs when the foot makes contact with the ground. More specifically, the ankle and foot will normally pronate 6 to 8 degrees during mid-stance. More than 8 to 12 degrees is called over-pronation. Mild pronation can be defined by the foot rolling inward 4 to 6 degrees, moderate pronation 6 to 10 degrees and severe over-pronation of 10 to 15 degrees. The footbed system 10 including a footbed insole 14 corrects over-pronation automatically.

In a supinated foot position, there is a shortage of pronation. The settlement takes place on the outside of the foot. High arches (holvoeten) have an increased risk of supination (underpronation). The footbed system 10 including a footbed insole 14 corrects over-pronation automatically.

As noted, one of the most ideal normals pronation settlement because the body is in balance as shown in FIG. 11D. The foot drops slightly inwards and turn off between the first and second toe. A normal foot position does not mean a neutral shoe. The footbed system 10 automatically provides a neutral foot position and insole without the wearer needing to take special action.

The neutral position provided by the footbed system 10 supports the foot. The materials/shapes used in the footbed system 10 promote the neutral position from the ankle relative to the lower leg toward an essentially 180 degreestraight line.

Six criteria for normalcy are:

1. The bisection of the lower third of the leg is parallel to the bisection of the Calcaneus.
2. The horizontal plane of the forefoot is perpendicular to the bisection of the Calcaneus.
3. There is a minimum 10 degree ankle dorsiflexion.
4. Leg must be vertical to the ground in frontal plane.
5. Leg must be vertical to the ground in sagittal plane.
6. There is no horizontal plane rotation.

Figure 9:
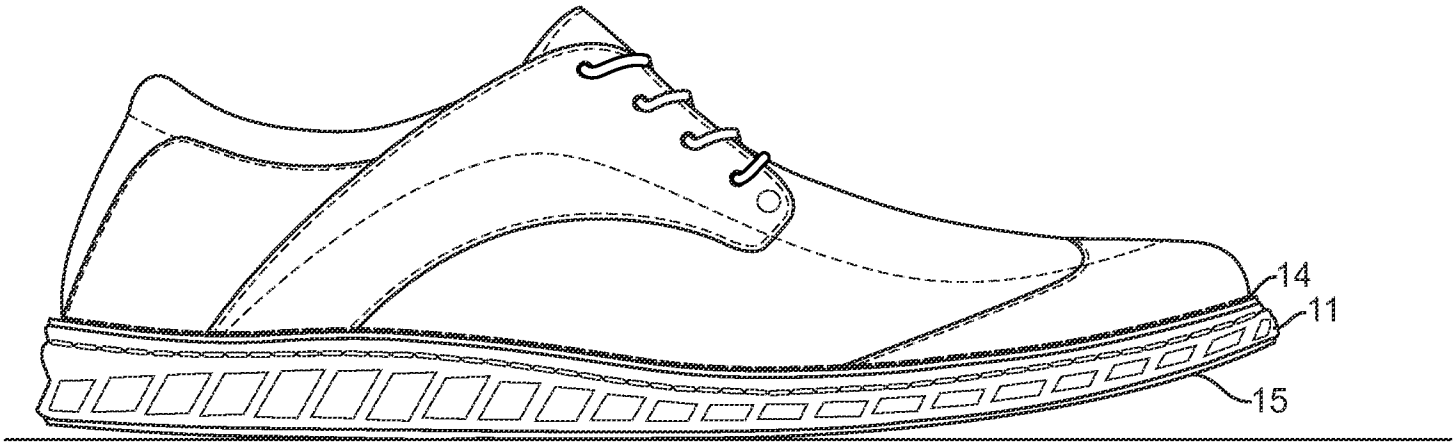
FIG. 9 shows a side view of a footwear incorporating a footbed system, according to one embodiment.

The footbed system 10 automatically promotes said criteria of normalcy. In one embodiment, the footbed system 10 comprises footwear such as shoes that allow proper foot positioning, and footwear including gait line control and steering mechanisms. As shown in FIG. 9, an embodiment of the footbed system 10 comprises a shoe including a gait line control mechanism and a steering mechanism, built in and under the shoe.

The materials/shapes used in the footbed system promotes the neutral position, wherein the shape of the insole mechanism 14 provides a lower pressure under the heel. Further, the side of the insole mechanism 14 is in the shape of the heel of a human foot. And, the material utilized in the insole mechanism 14 provides sideways pressure to the foot when the heel is receding downward into the insole heel pad 2, to stabilize the foot and correct the pronation or supination. Upper body weight pushes down on the heel bone which in turn compresses foams in the heel pad 2 and forefoot pad 3.

Different element sizes may be used relative to foot size. Embodiments of the invention further provide other footwear such as sandals including the insole, midsole and outsole mechanisms described herein, utilizing the natural gait line mechanism.

Embodiments of the invention provide improvements in shoes allowing improvements in human comfort with standing, walking and moving while wearing a shoe according to an embodiment of the invention.

The shoe/insole technique provides the guide for a responsible start to move without thinking how to move. The footbed system improves human biomechanics and reduces the discomfort in standing and moving.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A footbed system for footwear, the footbed system comprising:

an insole mechanism; and a midsole mechanism, wherein the insole mechanism is positioned on the midsole mechanism;

an arcuate gait line grove in the midsole mechanism, wherein the gait line groove extends from a lateral side of a heel area of the footwear toward a medial side of the heel area and back toward the lateral side of the heel area proximate an arch area of the footwear, wherein the gait line groove further extends along the lateral side of the arch area toward the medial side of a toe area of the footwear, and wherein a curvature of the arcuate gait line groove changes from convex in reference to the lateral side of the midsole mechanism to concave in reference to the lateral side of the midsole mechanism in a forefoot area located forward of the thinnest width of the midsole mechanism lengthwise; and wherein the insole mechanism comprises a footbed insole, a heel pad, and a forefoot pad;

wherein the heel pad is positioned in the heel area, the forefoot pad is positioned between the toe area and the arch area.

2. The footbed system of claim 1, wherein the heel pad has a substantially tri-oval shape.

3. The footbed system of claim 2, wherein the forefoot pad comprises a flexible elongated bed.

4. The footbed system of claim 1, wherein the forefoot pad includes a lift support in the forefoot pad.

5. The footbed system of claim 4, wherein the lift support is a round-shaped support extending from the forefoot pad proximal the medial side of the footbed insole.

6. The footbed system of claim 1, further comprising:

a first support pad positioned proximal the medial side of the footbed insole in the heel area;

a second support pad positioned proximal the medial side of the footbed insole between the toe area and the arch area; and a third support pad positioned proximal the lateral side of the footbed insole between the toe area and the arch area, wherein the support pads align a foot inward toward the arcuate gait line grove.

7. The footbed system of claim 6, wherein the midsole mechanism comprises a flexible elongated pad.

8. The footbed system of claim 7, further comprising an outsole mechanism positioned under the midsole mechanism, wherein the outsole mechanism comprises an opening for exposing said arcuate gait line grove in the midsole mechanism, and wherein said opening terminates prior to an edge of said outsole mechanism.

9. The footbed system of claim 1, wherein at least a portion of the forefoot pad is exposed through an opening in the footbed insole between the toe area and the arch area.

10. The footbed of claim 1, wherein the forefoot pad and the heel pad are integrated into the footbed insole.

11. A footbed system for footwear, the footbed system comprising:

an insole mechanism; and a midsole mechanism, wherein the insole mechanism is positioned on the midsole mechanism;

wherein the insole mechanism comprises a footbed insole, a heel pad, and a forefoot pad, wherein the forefoot pad includes a lift support, and wherein the lift support is completely surrounded by the forefoot pad;

wherein the heel pad is positioned in a heel area of the footwear, and the forefoot pad is positioned between a toe area of the footwear and an arch area of the footwear;

a first support pad positioned proximal a medial side of the footbed insole in the heel area;

a second support pad positioned proximal the medial side of the footbed insole between the toe area and the arch area; and a third support pad positioned proximal a lateral side of the footbed insole between the toe area and the arch area.

12. The footbed system of claim 11, wherein the forefoot pad comprises a flexible elongated bed.

13. The footbed system of claim 11, wherein the lift support is a round-shaped support extending from the forefoot pad proximal the medial side of the footbed insole.

14. The footbed system of claim 11, further comprising:

an arcuate gait line grove in an underside of the midsole mechanism, wherein the gait line groove extends from the lateral side of the heel area toward the medial side of the heel area and back toward the lateral side of the heel area proximate an arch area of the footwear, wherein the gait line groove further extends along the lateral side of the arch area toward the medial side of the toe area.

15. The footbed system of claim 11, wherein the heel pad has a substantially tri-oval shape.

16. The footbed system of claim 11, wherein the midsole mechanism comprises a flexible elongated pad.

17. The footbed system of claim 14, further comprising an outsole mechanism positioned under the midsole mechanism, wherein the outsole mechanism comprises an opening for exposing said arcuate gait line groove in the midsole mechanism, and wherein said opening terminates prior to an edge of said outsole mechanism.

18. The footbed of claim 17, wherein:

at least a portion of the outsole mechanism comprises harder material relative to at least a portion of the midsole mechanism in the area of the arcuate gait line groove where at least a portion of the midsole mechanism is exposed.

19. The footbed of claim 18, wherein the density of at least a portion of the midsole mechanism is less relative to the at least a portion of the outsole mechanism where the outsole mechanism is not layered to the midsole mechanism.

20. The footbed system of claim 11, wherein at least a portion of the forefoot pad is exposed through an opening in the footbed insole between the toe area and the arch area.

21. A footbed system for footwear, the footbed system comprising:

a sole portion;

an arcuate gait line grove in the sole portion of the footbed system, wherein the gait line groove extends from a lateral side of a heel area of the footwear toward a medial side of the heel area and back toward the lateral side of the heel area proximate an arch area of the footwear, wherein the gait line groove further extends along the lateral side of the arch area toward the medial side of a toe area of the footwear, and wherein a curvature of the arcuate gait line groove changes from convex in reference to the lateral side of the sole portion to concave in reference to the lateral side of the sole portion in a forefoot area located forward of the thinnest width of the sole portion lengthwise.

22. The footbed system of claim 21, wherein the sole portion of the footbed system is an outsole mechanism, and wherein the arcuate gait line groove is disposed in the outsole mechanism.

23. The footbed system of claim 21, wherein the sole portion of the footbed system is a midsole mechanism, and wherein the arcuate gait line groove is disposed in the midsole mechanism.

24. The footbed system of claim 23, further comprising:

an insole mechanism, wherein the insole mechanism comprises a footbed insole, a heel pad, and a forefoot pad.

25. The footbed system of claim 24, wherein the forefoot pad includes a lift support.

26. The footbed system of claim 25, wherein the heel pad is positioned in the heel area, and the forefoot pad is positioned between the toe area and the arch area.

27. The footbed system of claim 26, further comprising an outsole mechanism positioned under the midsole mechanism, wherein the outsole mechanism comprises an opening for exposing said arcuate gait line groove in the midsole mechanism, wherein said opening terminates prior to an edge of said outsole mechanism.

28. The footbed system of claim 27, further comprising:

a first support pad positioned proximal the medial side of the footbed insole in the heel area;

a second support pad positioned proximal the medial side of the footbed insole between the toe area and the arch area; and a third support pad positioned proximal the lateral side of the footbed insole between the toe area and the arch area, wherein the support pads align a foot inward toward the arcuate gait line groove.

29. The footbed system of claim 28, wherein at least a portion of the forefoot pad is exposed through an opening in the footbed insole between the toe area and the arch area.

* * * * *